United States Patent [19]

Ecer

[11] Patent Number: 4,630,692

[45] Date of Patent: Dec. 23, 1986

[54] CONSOLIDATION OF A DRILLING ELEMENT FROM SEPARATE METALLIC COMPONENTS

[75] Inventor: Gunes M. Ecer, Irvine, Calif.

[73] Assignee: CDP, Ltd., Newport Beach, Calif.

[21] Appl. No.: 743,308

[22] Filed: Jun. 10, 1985

Related U.S. Application Data

[63] Continuation-in-part of Ser. No. 656,641, Oct. 1, 1984, Pat. No. 4,554,130, which is a continuation-in-part of Ser. No. 633,508, Jul. 23, 1984, Pat. No. 4,562,892.

[51] Int. Cl.[4] ..... E21B 10/00

[52] U.S. Cl. ..... 175/330; 76/108 A; 148/127; 172/747; 175/332; 175/374; 175/410; 419/8; 419/36; 419/42; 419/49; 419/68

[58] Field of Search ..... 419/8, 36, 37, 42, 49, 419/68; 148/127, 39; 76/108 A; 172/747; 175/374, 409, 410, 330, 332

[56] References Cited

U.S. PATENT DOCUMENTS

| | | | |
|---|---|---|---|
| 3,235,316 | 2/1966 | Whanger | 308/8.2 |
| 3,310,870 | 3/1967 | Parikh et al. | 29/420.5 |
| 3,453,849 | 7/1969 | Clarke et al. | 72/46 |
| 3,721,307 | 3/1973 | Mayo | 175/372 |
| 3,984,158 | 10/1976 | Sorensen | 308/8.2 |
| 3,995,917 | 12/1976 | Quinlan | 308/8.2 |
| 4,004,889 | 1/1977 | Gale et al. | 419/8 |
| 4,052,802 | 10/1977 | Moen et al. | 419/8 |
| 4,074,922 | 2/1978 | Murdoch | 308/8.2 |
| 4,172,395 | 10/1979 | Keller | 419/8 |
| 4,293,619 | 10/1981 | Landingham et al. | 419/8 |
| 4,300,959 | 11/1981 | Hurwitz | 148/127 |
| 4,339,271 | 7/1982 | Isaksson et al. | 75/223 |
| 4,351,858 | 9/1982 | Hunold | 427/193 |
| 4,359,336 | 11/1982 | Bowles | 75/226 |
| 4,365,679 | 12/1982 | Nederveen et al. | 419/8 |
| 4,368,788 | 1/1983 | Drake | 175/374 |
| 4,372,404 | 2/1983 | Drake | 175/374 |
| 4,379,725 | 4/1983 | Kemp | 148/4 |
| 4,495,252 | 1/1985 | O'Brien et al. | 419/8 |
| 4,539,175 | 9/1985 | Lichti et al. | 419/8 |

OTHER PUBLICATIONS

Powder Metallurgy Near Net Shapes, by HIP (SME 1982).

New Approach Widens the Use of HIP P/M (Precision Metal 1982).

Hot Isostatic Processing (MCIC Report, Nov. 1977).

Metals Joining and Coating Using the Ceracon Process (American Society for Metals, Metals/Materials Technology Series).

*Primary Examiner*—Stephen J. Lechert, Jr.

*Attorney, Agent, or Firm*—William W. Haefliger

[57] ABSTRACT

The method of forming a cutter, which includes a core and a wear resistant insert defining a body means which includes (a) applying to the body means a mixture of:
  (i) wear resistant metallic powder, and
  (ii) binder (b) volatilizing the binder, (d) and applying pressure to the body means and powdered metal, at elevated temperature to consolidate same.

22 Claims, 24 Drawing Figures

EVERY CONTINUOUS ARROW PATH FROM STEP 1 TO STEP Nº 14 (SEE TABLE I) REPRESENTS A MANUFACTURING PROCESS

CONSOLIDATION OF A DRILLING ELEMENT FROM SEPARATE METALLIC COMPONENTS

BACKGROUND OF THE INVENTION

This application is a continuation-in-part of my prior application Ser. No. 656,641, filed Oct. 1, 1984, now U.S. Pat. No. 4,544,130 which is a continuation-in-part of Ser. No. 633,508, filed July 23, 1984 now U.S. Pat. No. 4,562,892.

This invention relates generally to metal powder consolidation as applied to one or more metallic bodies, as for example are used in drilling, and more particularly to joining or cladding of such bodies employing powdered metal consolidation techniques.

As described in U.S. Pat. Nos. 3,356,496 and 3,689,259, it is known to utilize a pressurizing medium consisting of refractory particulate matter and high temperatures to consolidate (or densify) a metallic object. In this approach, the pressure applied by a press is transmitted through a hot ceramic particle bed to the hot preformed part having a density less than that of its theoretical density. The pressurization of the part occurring in all directions causes voids, gaps or cavities within the part to collapse and heal, the part being densified to a higher density which may be equal to its theoretical density.

Conventional powder metallurgy techniques are limited to the production of parts having shapes that can be produced by closed die pressing in forming of the powder preform. Attempts to produce more complex shapes having 100% density have required the use of lengthy canning procedures (1) to protect the part from the pressurizing gas. Another approach (2) to powdered metal consolidation utilizes preforms requiring no canning in HIP (i.e. hot isostatic pressing) yet it is limited to the shapes that can be produced by powder pressing in a die. In all cases, the preform consolidation takes place in a gas pressurized autoclave (HIP) which, as mentioned earlier, is suitable for consolidation of products whose properties are not sensitive to long time exposures to high temperatures. HIP is described fully in Reference No. 3.

It is seen, therefore, that development of a practical powdered metal process able to consolidate 100% dense shapes, too complex to produce by die pressing, utilizing short time high temperature exposure and without the need for canning would satisfy a need existent in the metal forming industry. Such a process would also meet the need for substantially lower parts costs. Prior patents (4–7) relating to the subject of isostatic pressing of metal workpieces teach that if the parts being consolidated, or to be joined, have cavities or cracks or clearances between the peices accessed by the pressurizing gas, complete densification can not take place. Parts to be consolidated or joined must, therefore, be isolated from the pressurizing gas by an impermeable casing (8).

It is a major object of the invention to provide a process or processes meeting the above needs, and otherwise providing unusual advantages as will appear. Joining and cladding processes to be described do not require canning or casings which can be extremely expensive. Further novelty exists in the use of fugitive organic binders and volatile solvents to apply a layer of mettalic powders over the surface openings of the voids or clearances between the pieces to be joined or to be clad. Major objectives include the provision of:

1. Methods of joining two or more metallic objects, as for example are used in drilling, with the object of making a bigger and more complexly shaped object, 2. methods of cladding a metallic object with a layer of another metallic material with or without a layer of third material between the two, 3. a method of combining two or more metallic ceramic objects as in 1 and 2 above and afterward chemically removing the ceramic to provide a predesigned cavity.

The basic method of consolidating metallic body means, as for example a drilling cutter, includes the steps:

(a) applying to the body means a mixture of
  (i) metallic powder,
  (ii) fugitive organic binder, and
  (iii) volatile solvent,
(b) the binder and solvent at elevated temperatures,
(c) and applying pressure to the body means and metallic powder to consolidate same.

The said mixture may be applied to the body means by dipping, painting or spraying; the body means may have cladding consolidated thereon by the above method; the body means may comprise multiple bodies joined together by the consolidated powder metal in the mixture; one or more of the bodies to be joined may itself be consolidated at the same time as the applied powder metal in the mixture is consolidated; and the consolidation may take place in a bed of grain (as for example ceramic particualte) adjacent the mixture.

The invention also relates generally to rolling cutters utilized in earth drilling tools, commonly known as tri-cone bits, hole openers, and big hole bits such as those used in mining and tunneling. The invention provides a unique approach to the production of rolling cutters by which composite cutters can be produced from granular, wrought and insert forms of the materials used in cutters. It provides means to improve efficiency of earth drilling, by incorporating, into the cutting teeth, inserts of cobalt cemented tungsten carbide or diamond-carbide-matrix alloy composites which, being resistant to abrasive wear, retain a sharp cutting edge or edges on the cutter tooth or teeth.

This aspect of the invention is primarily concerned with the cutting elements (or teeth) which are integral with the cutter structure, as opposed to carbide cutting elements which are force fitted into precision holes drilled into the cutter, as is expensively the practice presently. In drilling, the bit is rotated and the cutters roll around the bottom of the hole, each tooth intermittently penetrating into the rock, crushing, chipping and/or gouging it. Erosion and wear immediately begin to dull the sharp cutting tips of the teeth, leading to a steady drop in the efficiency of the rock drilling action. To prolong the "sharpness", a self-sharpening effect is created, by hardfacing only one side of each tooth. To maintain the gage of the hole being drilled, the outermost surfaces of the teeth (on the gage row) are hardfaced as well. This practice has been applied to bits that are produced using the conventional approach, namely, rolling cutters produced from steel forgings by machining.

Advent of powder metallurgy means of producing load bearing parts in recent years has opened a new avenue for the less costly production of rolling cutters, as for example disclosed in U.S. Pat. Nos. 4,365,679 (Nederveen et al), 4,368,788 (Drake) and 4,372,404 (Drake) as well as applicant's prior U.S. patent application Ser. No. 656,641, filed Oct. 1, 1984, of which the present application is a continuation-in-part.

The powder metallurgy approach can also provide a more durable self-sharpening effect by incorporating, into the cutter teeth, materials that are characterized by wear resistance, and which are longer lasting or more durable than the hardfacing alloys utilized in existing bits. This invention enables use of two classes of materials as the hard materials to create the self-sharpening effect. These are cobalt cemented tungsten carbide composites, and diamond carbide-metal binder composites. Unlike the composite materials having "substantially continuous mechanical property gradient" as suggested by the Drake patents, the present invention utilizes sharp boundaries between the hard material composites to produce sharper cutting edges on the teeth. The sharp changes in composition, i.e., compositional change from the steel matrix of the tooth to the composition of the hard composite insert (or layer), are maintained, in the present invention, through the use of a short time-high temperature-high pressure consolidation technique.

Accordingly, this invention introduces a new process involving preforms of the rolling cutters prepared by application of powder metal layers to outside and inside surfaces of a cold pressed and sintered, partly solid core piece, or a solid core piece, and assembling thereto inserts of hard, wear resistant, composite materials at locations where the wear resistance would be needed, then heating the preform to an elevated temperature or temperatures and forging it within a hot bed of granular refractory material by applying pressure to the granular bed within a die cavity. The powder metal applied to outside surfaces of the core can be, as described in my prior application Ser. No. 656,641 (incorporated herein), a hard wear resistant alloy, while powders applied within the internal surfaces may be alloys selected for their suitability as bearings to withstand sliding and impact wear. The preforms can be prepared at room temperature by slurry application of the powders where a fugitive organic binder in the slurry creaters sufficient bonding between powder particles, and between powder and solid members of the preform, to be easily handled during processing.

In this approach to manufacture of rolling cutters, relatively short time exposure to high temperatures minimizes diffusional exchange of matter between dissimilar materials in intimate contact. Thus, extensive chemical gradients, at hard insert to steel core interfaces, do not develop. As a consequence, a sharp cutting edge of the insert is easily maintained during drilling, and leads to higher drilling efficiency.

As described previously, milled-tooth cutters are currently machined from a single piece of a hardenable metal, yet various portions of the cutter require differing properties which are difficult to achieve in an optimized manner using the same material and allowing it to respond to heat treatments. The additional materials are, therefore, sometimes applied through welding which results in layers of non-uniform thickness and chemistry. Thus, the existing milled-tooth cutter manufacturing art provides a compromised set of engineering and mechanical properties.

A further difficulty with the existing manufacturing art is its large labor content, since all of the exterior and interior surfaces, including those of cutting elements and bearings, are developed by milling and grinding from a single forging. These milling and grinding operations, and the associated quality inspections, lengthen the manufacturing operations, thus adding substantially to the final manufacturing cost. Cutter surfaces may be treated to impart the desired localized properties; however, these treatments are usually long or inadequate, or have side effects that compromise overall properties. In addition, hardfacing of the milled teeth, as discussed earlier, results in a a non-uniform deposit, thus compromising the self-sharpening effect (expected only when one side of the tooth is hardfaced), and occasionally creates "notch-like" intrusions of the deposited alloy into the forged cutter body, thus weakening it.

The recently provided powder metallurgy methods to produce cutters suffer from several disadvantages as well, for example, the compositional gradient, to provide a gradient of properties suggested by Drake (above), is not only complicated and time consuming to produce, but can produce the opposite effect, namely creation of a region of inferior properties within the gradient zone. The compositional gradient, after all, is a continual dilution of the alloys present at the extremeties. "Dilution," as is well known by those who are familiar with the metallurgical arts, ia a major problem where a high-hardness, high-carbide content alloy is fusionwelded onto an alloy of differing, yet purer, composition. The "diluted" region is the region between the two alloys and is formed by mixing of the two alloys, thus creating a layer of high brittleness and low strength.

As contrasted with such prior techniques, the present invention deliberately avoids alloy gradients, in veiw of the problems referred to. This is accomplished through applications of discrete layers of differing materials and by use of a short-time, hot-pressing technique where atomic diffusion is limited only to the interface to form a strong metallurgical bond, but not to cause excessive mixing (dilution).

Nederveen and Verburgh's (above) powder metallurgy cutters as disclosed in U.S. Pat. No. 4,365,679 utilize high-temperature spraying techniques to apply powders to form surface layers. This approach most readily incorporates oxides into the alloy layer and to the alloy layer/cutter body interfaces, which weaken the structure. The present invention, on the other hand, accomplishes the cladding (applying a layer of one metal on the other) by room-temperature painting, spraying or dipping in a slurry of the powder metal, and thus provides a means to produce cutters of superior quality.

No such prior art suggests the use of separately manufactures solid wear resistant inserts at the cutting edges of rolling cutter teeth in a way to provide self-sharpening action during drilling, and to produce the cutters by the use of a short-time high temperature, high pressure powder metallurgy consolidation techniques. Thus, one objective of the present invention is to provide uniform and structurally sound, hard-wear resistant inserts, integrally bonded to the cutting teeth.

Another objective of the invention is to reduce the labor content of manufacture of the drill bit cutters by utilizing the above mentioned consolidation process, by which a compositely-structured cutter can be produce from its powders or powder plus solid components combinations to a net shape near the final intended shape of the cutter, eliminating much of the machining which would otherwise be needed.

A further objective is to increase the freedom of the material selection for the various components of the cutter as a direct result of the use of a short-time/high-temperature consolidation process which does not affect the useful properties of the cutter and its components. Thus, materials and material combinations heretofore not used in roller bit cutters of steel tooth design, may be used without fear of detrimental side effects associated with long-time/high-temperature processing operations. In this regard, the present invention offers the use of cobalt cemented tungsten carbide inserts and diamond containing composites to be used as wear resistant, cutting elements integrally consolidated with the cutter teeth.

These and other objects and advantages of the invention, as well as the details of an illustrative embodiment, will be more fully undertood from the following specification and drawings in which:

DRAWING DESCRIPTION

Figure 2A:
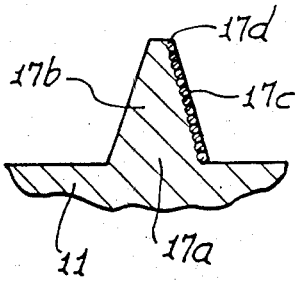
FIG. 2 is an elevation, in section, showing a milled tooth conical cutter.
Figure 3:
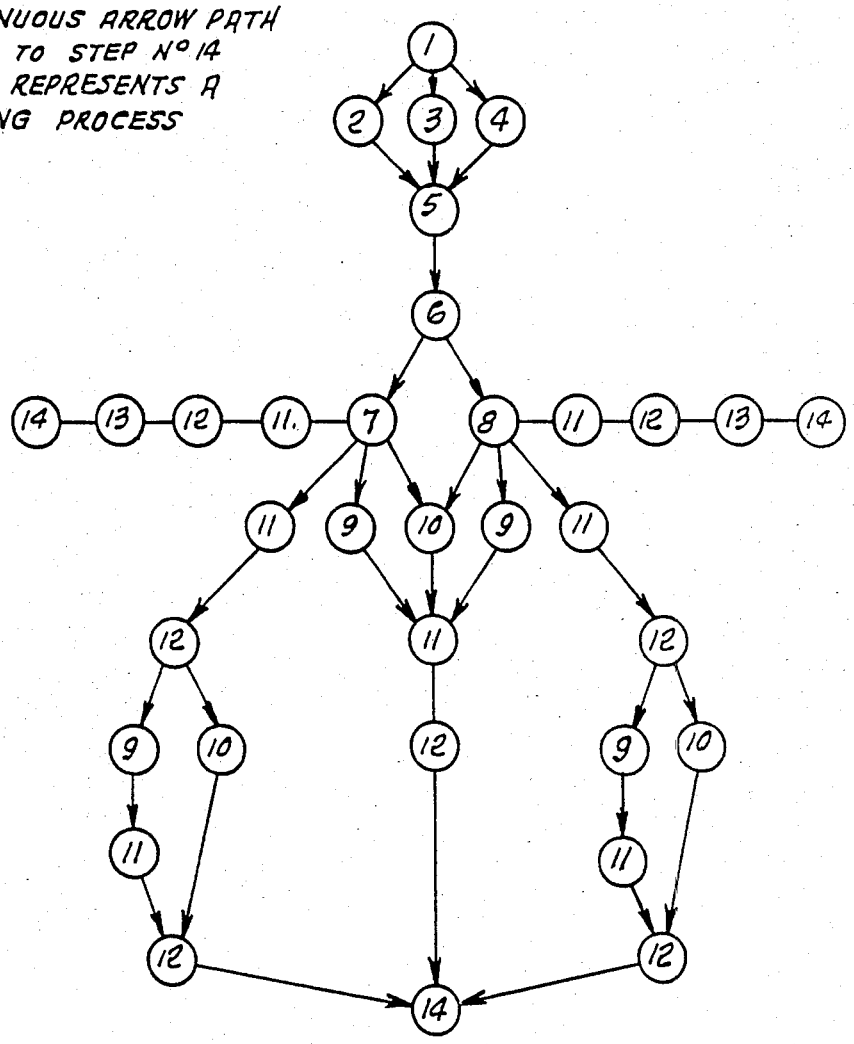
Figure 6:
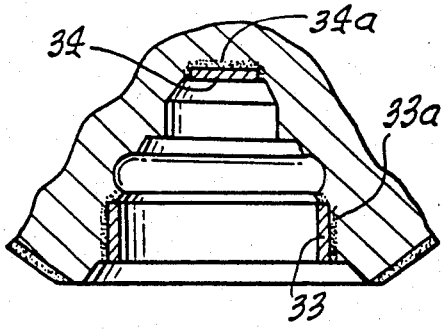
Figure 7:
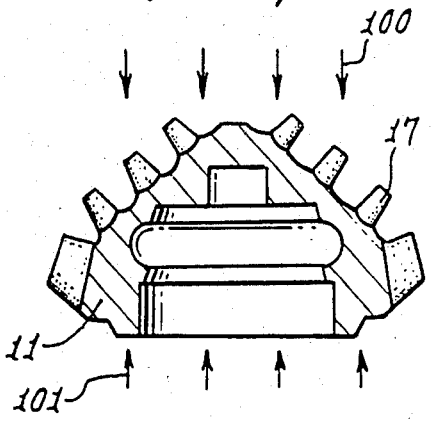
Figure 4A:
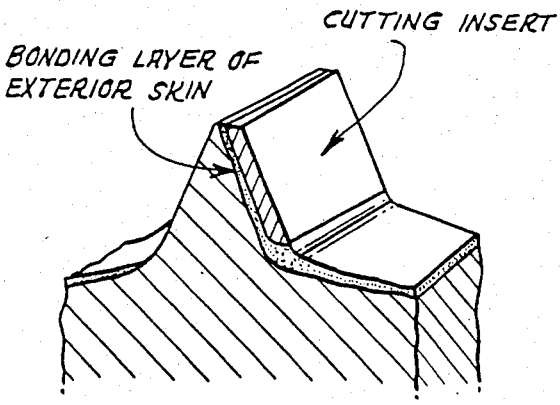
Figure 4B:
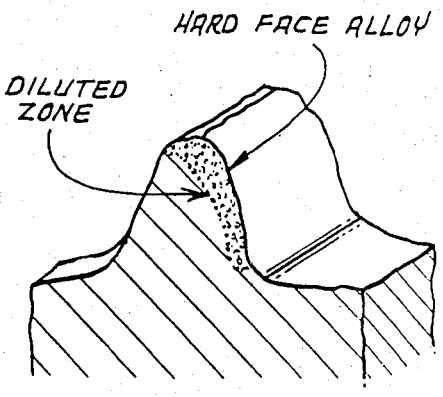
Figure 4C:
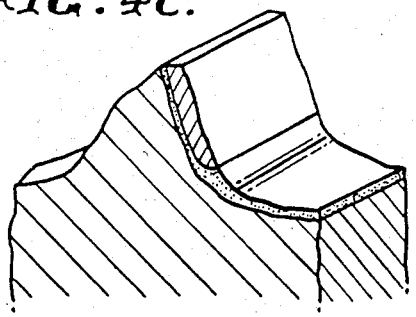
Figure 4D:
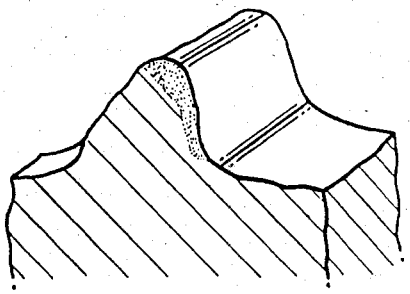
Figure 5A:
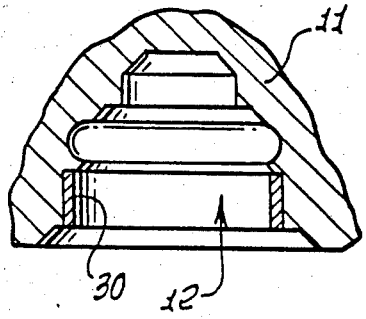
Figure 5B:
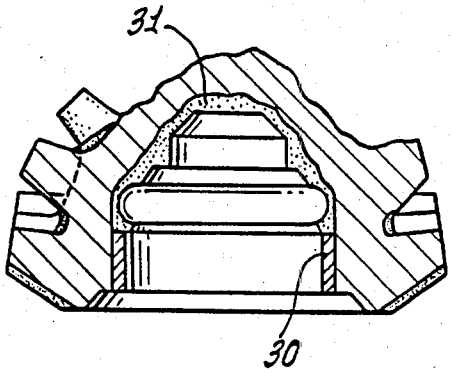
Figure 5C:
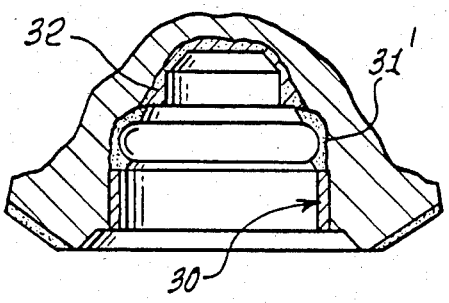
Figure 5D:
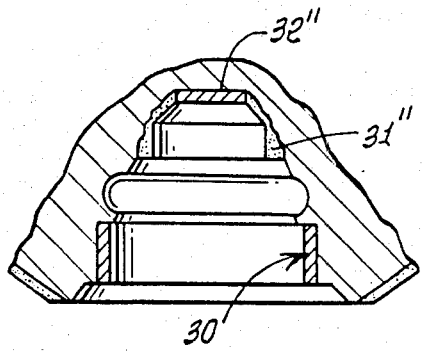
Figure 8:
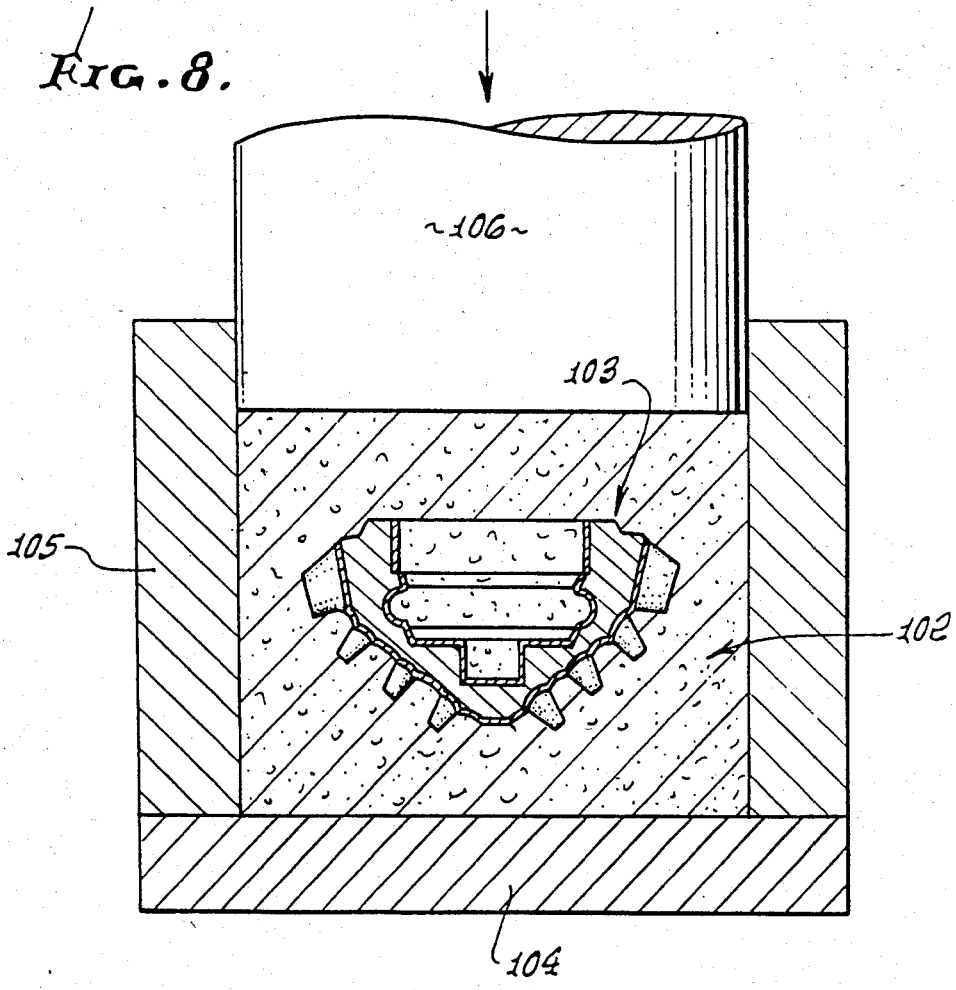
Figure 9:
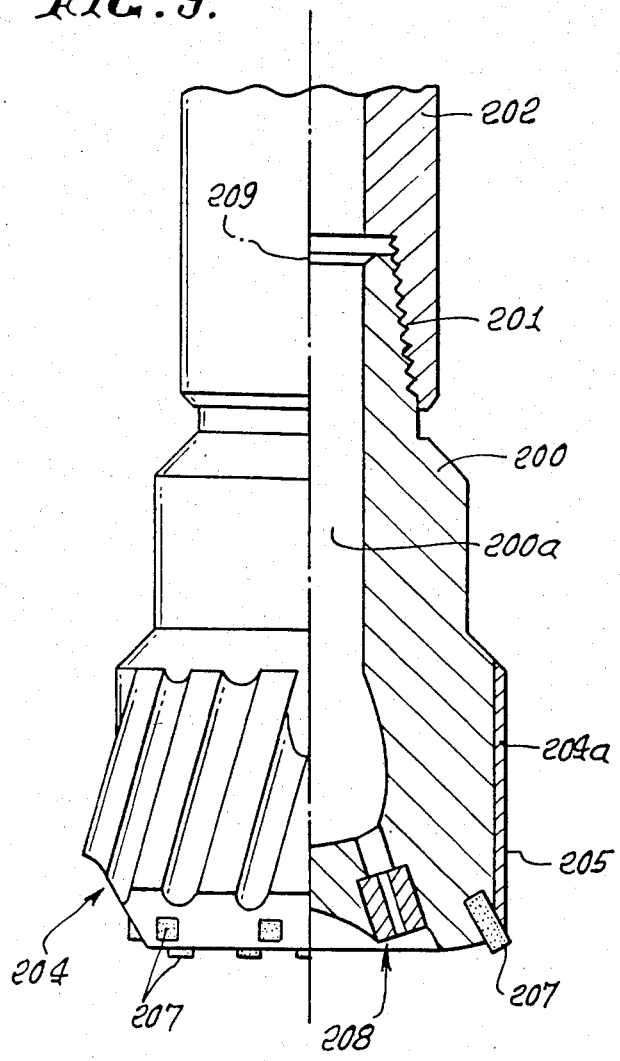
Figure 10:
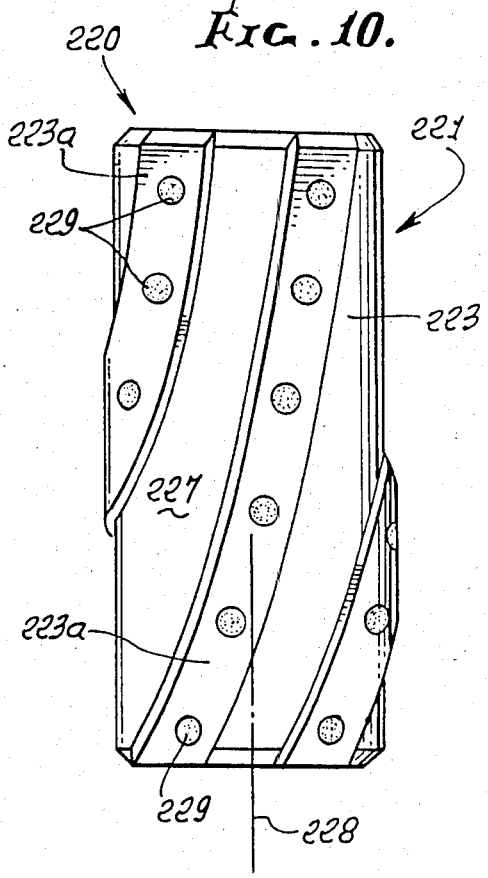
Figure 11:
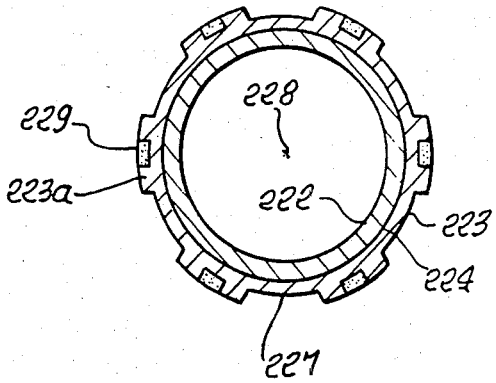
Figure 12:
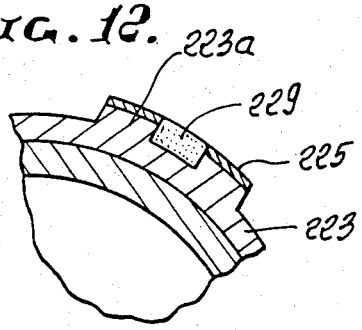
Figure 12A:
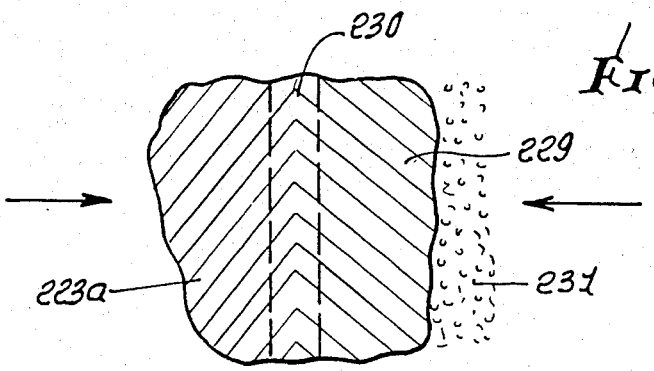
Figure 13:
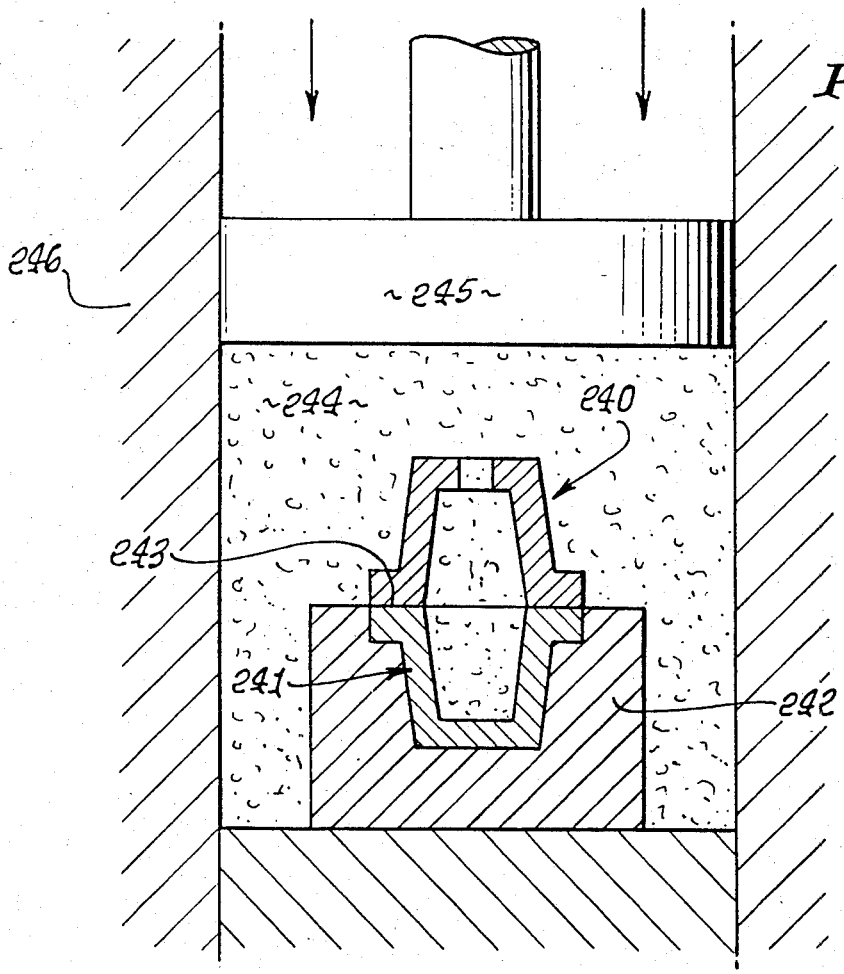
Figure 14:
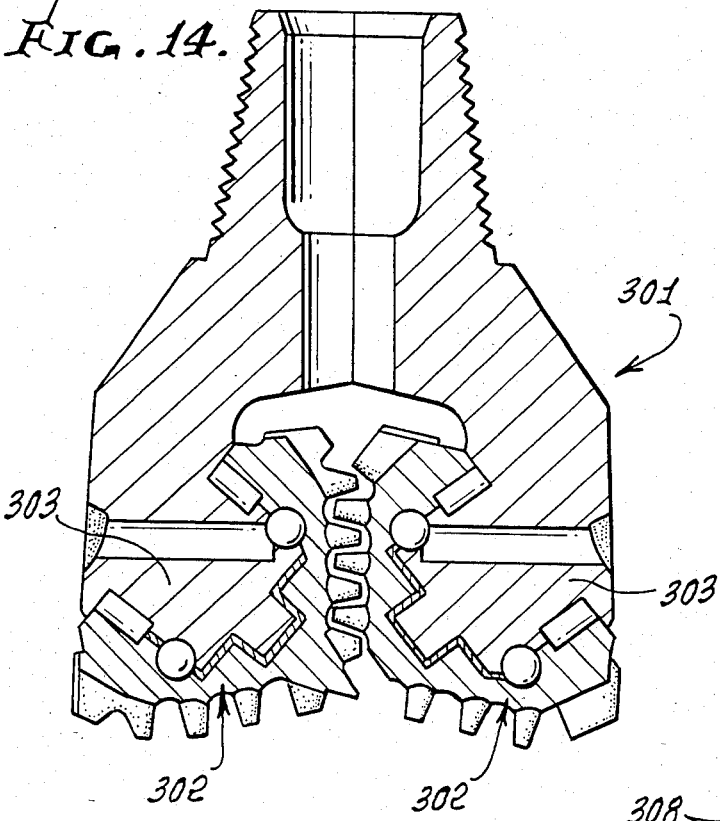
Figure 15:
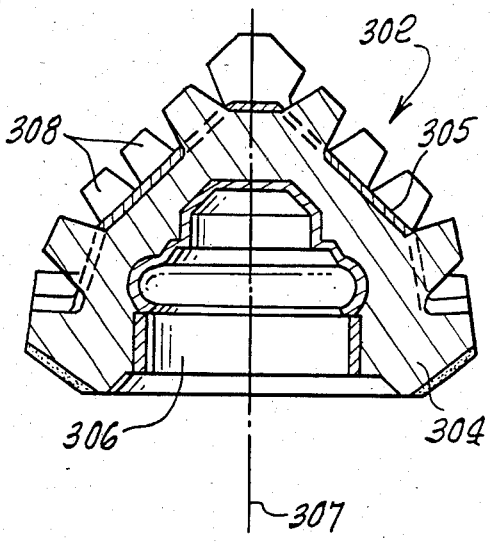
Figure 16:
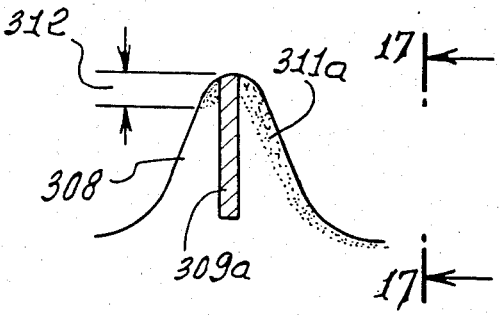
Figure 17:
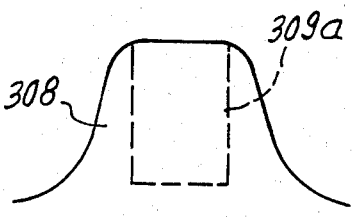
Figure 18:
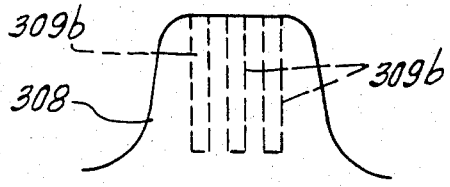
Figure 19:
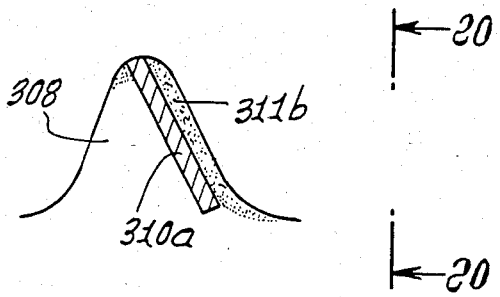
Figure 20:
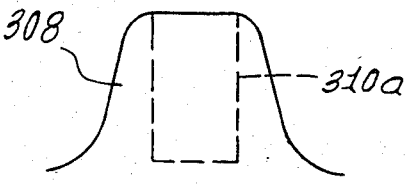
Figure 21:
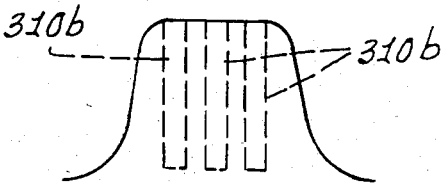
Figure 22:
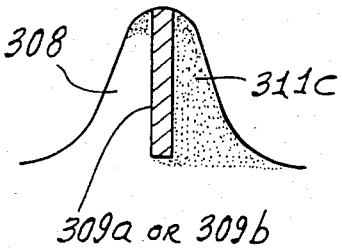
Figure 23:
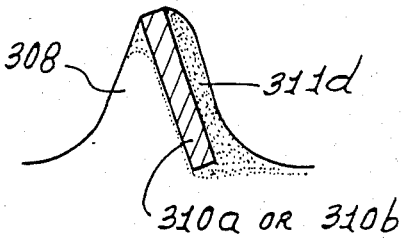
Figure 24:
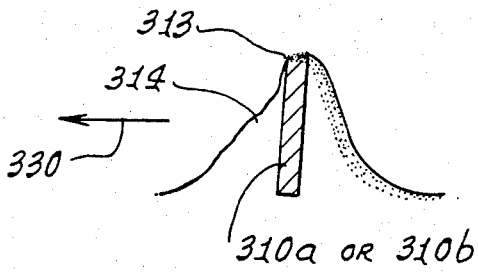

FIG. 2*a* is a cross section taken through a tooth insert;

FIG. 3 is a flow diagram showing steps of a manufacturing process for the composite conical drill bit cutter;

FIGS. 4(*a*) and 4(*c*) are perspective views of a conical cutter tooth according to the invention, respectively before and after downhole service use; and FIGS. 4(*b*) and 4(*d*) are perspective views of a prior design hardfaced tooth, respectively before and after downhole service;

FIGS. 5(*a*)–5(*d*) are elevations, in section, showing various bearing inserts employed to form interior surfaces of proposal conical cutters; and FIG. 6 is an elevation, in section, showing use of a powdered metal bonding layer between a bearing insert and the core piece;

FIGS. 7 and 8 show process steps;

FIG. 9 is a side elevation showing a drill bit to which wear resistant cladding has been applied and to which nozzle and cutter elements have been bonded;

FIG. 10 is a side elevation of a stabilizer sleeve processed in accordance with the invention;

FIG. 11 is a horizontal section through the FIG. 10 sleeve;

FIG. 12 is an enlarged view showing a part of the FIG. 10 and 11 sleeve;

FIG. 12*a* is a fragmentary view;

FIG. 13 is a section showing joining of two bodies;

FIG. 14 is an elevation, in section, showing a two-cone rotary drill bit, with intermeshing teeth to facilitate cleaning;

FIG. 15 is an elevation, in section, showing a milled tooth rolling cutter;

FIG. 16 is a cross-sectional view showing a cutter tooth, insert and wear resistant layer of powder material;

FIG. 17 is a side elevation taken on lines 17—17 of FIG. 16;

FIG. 18 is a view like FIG. 17, showing a modification;

FIG. 19 is a view like FIG. 16, showing a further modification;

FIG. 20 is a side elevation taken on lines 20—20 of FIG. 19;

FIG. 21 is a view like FIG. 20, showing a modification;

FIGS. 22 and 23 are like FIGS. 16 and 19 showing additional modification; and FIG. 24 is a view like FIG. 16, showing the tooth after wear in service.

DETAILED DESCRIPTION

Figure 1:
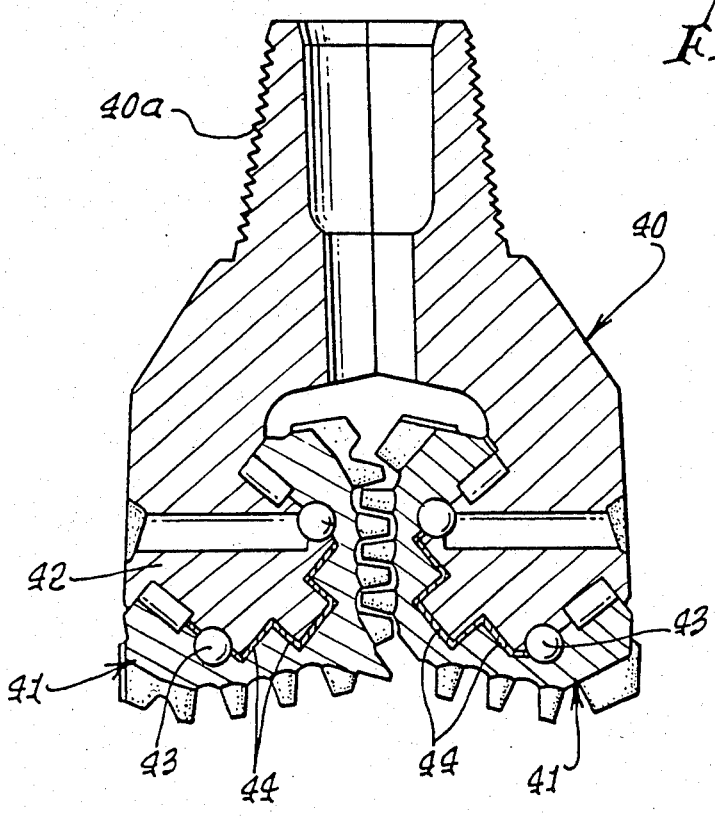
FIG. 1 is an elevation, in section, showing a two-cone rotary drill bit, with intermeshing teeth to facilitate cleaning.

In FIG. 1, the illustrated improved roller bit cutter 10 processed in accordance with the invention includes a tough, metallic, generally conical and fracture resistant core 11. The core has a hollow interior 12 and defines a central axis 13 of rotation. The bottom of the core is tapers at 14, and the interior includes multiple successive zones 12*a*, 12*b*, 12*c* and 12*e* concentric to axis 13, as shown. An annular metalic radial (sleeve type) bearing layer 15 is carried by the core at interior zone 12*a* to support the core for rotation. Layer 15 is attached to annular surface 11*a* of the core, and extends about axis 13. It consists of a bearing alloy, as will appear.

An impact and wear resistant metallic inner layer 16 is attached to the core at its interior zones 12*b*–12*e*, to provide an axial thrust brearingl as at end surface 16*a*. A plurality of hard metallic teeth 17 are carried by the core, as for example integral therewith at the root ends 17*a* of the teeth. The teeth also have portions 17*b* that protrude outwardly, as shown, with one side of each tooth carrying an impact and wear resistant layer 17*c* to provide a hard cutting edge 17*d* as the bit cutter rotates about axis 13. At least some of the teeth extend about axis 13, and layers 17*c* face in the same rotary direction. One tooth 17' may be located at the extreme outer end of the core, at axis 13. The teeth are spaced apart.

Finally, a wear resistant outer metallic skin or layer 19 is on and attached to the core exterior surface, to extend completely over that surface and between the teeth 17.

In accordance with an important aspect of the invention, at least one or two layers 15, 16 and 19 consists essentially of consolidated powder metal, and preferably all three layers consist of such consolidated powder metal. A variety of manufacturing schemes are possible using the herein disclosed hot pressing technique and the alternative means of applying the surface layers indicated in FIG. 2. It is seen from the previous discussion that surface layers 15, 16 and 19 are to have quite different engineering properties than the interior core section 11. Similarly, layers 16 and 19 should be different than 15, and even 16 should differ from 19. Each of these layers and the core piece 11 may, therefore, be manufactured separately or applied in place as powder mixtures prior to cold pressing. Thus, there may be a number of possible processing schemes as indicated by arrows in FIG. 3. The encircled numbers in this figure refer to the possible processing steps (or operations) listed in below Table 1. Each continuous path in the figure, starting from Step No. 1 and ending at Step No. 15, defines a separate processing scheme which, when followed, are capable of producing integrally consolidated composite conical cutters.

TABLE I

A list of major processing steps which may be included in the processing:

1. Blend powders.
2. Cold press powder to pre-form green interior core piece 11 (see FIG. 2 for location), which includes teeth 17.

3. Cold press and sinter or hot press powder to preform, less than fully dense, core piece 11. Sintering or hot pressing can usually be done at a preferred temperature range 1800° F. to 1250° F. If sintered, typical sintering times may be 0.5 to 4 hours depending on temperature.
4. Forge or cast fully dense core piece 11.
5. Apply powdered hard metal compound skin 19; i.e., by painting, slurry dipping or cold spraying a hard metal powder mixed with a fugitive organic binder and a volatile solvent.
6. Place tungsten carbide inserts 17c on teeth faces.
7. Apply thrust-bearing alloy powder layer 16; i.e., by painting, slurry dipping or cold spraying an alloy-binder mixture as in Step 5, above.
8. Apply powdered radial bearing alloy 15 in the core piece; i.e. by painting, slurry dipping or cold spraying an alloy-binder mixture as in Step 5 above.
9. Apply powdered radial blaring alloy 15 in the cold piece; i.e., by painting, slurry dipping or cold spraying an alloy-binder mixture as in Step 5 above.
10. Place wrought, cast or sintered powder metal radial bearing alloy 15 in the core piece 11.
11. Bake or dry to remove binder from powder layers 16, 16 and/or 19. Drying may be accomplished at room temperature overnight. If slurry applied layers are thick the preform may be baked in non oxidizing atmosphere at 70–300° F. for several hours to assure complete volatilization of the volatile portion of the binder.
12. Hot press to consolidate the composite into a fully dense (99+ of theoretical density) conical cutter. Typically, hot pressing temperature range of 1900–2300° F. and pressures of 20 to 50 tons per square inch may be required.
13. Weld deposit radial-bearing alloy 15 in the densified cone.
14. Final finish; i.e., grind or machine ID profile, finish grind bearings, finish machine seal seat, inspect, etc.

The processing outline includes only the major steps involved in the flow of processing operations. Other secondary operations that are routinely used in most processing schemes for similarly manufactured products, are not included for sake of simplicity. These may be cleaning, manual patchwork to repair small defects, grit blasting to remove loose particles or oxide scale, dimensional or structural inspections, etc.

All of the processing steps are unique, as may easily be recognized by those who are familiar with the metallurgical arts in the powder metals processing filed. Each scheme provides a number of benefits from the processing point of view, and some of which are listed as follows:

(1) All assembly operations; i.e., painting, spraying, placing, etc., in preparing the composite cutter structure for the hot-pressing operation (Step No. 12 in Table 1) are performed at or near room temperature. Thus, problems associated with thermal property differences or low strength, unconsolidated state of the composite cone prior to hot densification, are avoided. Repair work, geometrical or dimensional control, and in-process handling are greatly simplified.

(2) Application of powdered metal or alloy or metal compound surface layers, using volatile binders, such as cellulose acetate, corn starch and various distilled products, provide sturdy powder layers strongly held together by the binding agent, thus adding to the green strength of the total unconsolidated cone structure. This makes it easy to control surface layer thickness, handling of the assembly in processing and provides mechanical support for the carbide inserts.

(3) Low-temperature application of aforementioned surface layers avoids pitfalls associated with high-temperature spraying of powders.

(4) The proposed schemes in every case produce a near-net-shape product, greatly reducing the labor-intensive machining operations required in the conventional conical cutter production.

CONE MATERIALS

Figure 2:
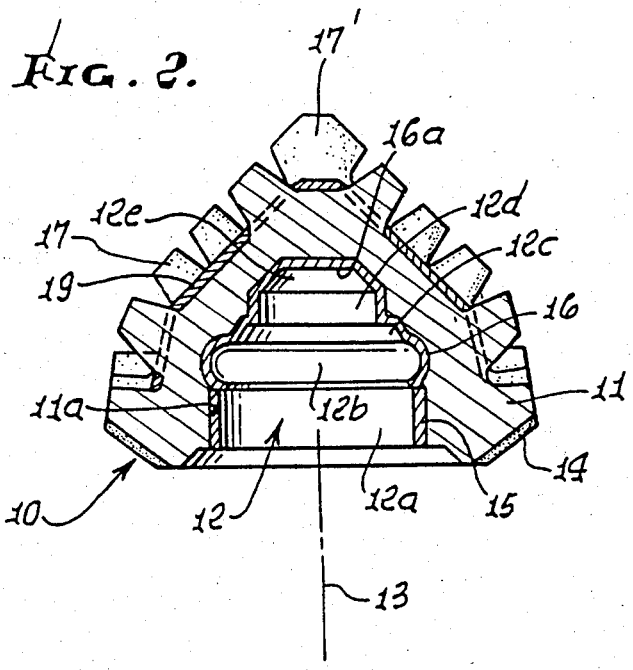

Various sections of the cone cross-section have been identified in FIG. 2, each requiring different engineering properties to best function in service. Consequently, materials for each section should be selected separately.

Interior core piece 11 should be made of an alloy possessing high strength and toughness, and prefereably require thermal treatments below 1700° F. (to reduce damage due to cooling stresses) to impart its desired mechanical properties. Such restrictions can be met by the following classes of materials:

(1) Hardening grades of low-alloy steels (ferrous base) with carbon contents ranging nominally between 0.1 and 0.65%, manganese 0.25 to 2.0%, silicon 0.15 to 2.2%, nicklet to 3.75%, chromium to 1.2%, molybdenum to 0.40%, vanadium to 0.3% an remainder substantially iron, total of all other elements to be less than 1.0% weight.

(2) Castable alloy steels having less than 8% total alloying element content; most typically ASTM-A148-80 grades.

(3) Ultra-high strength steels most specifically known in the industry as: D-6A, H-11, 9Ni-4Co, 18-Ni maraging, 300 m, 4130, 4330V, 4340. These steels nominally have the same levels of C, Mn, and Si as do the low-alloy steels described in (1) above. However, they have higher contents of other alloying elements: chromium up to 5.0%, nickel to 19.0%, molybdnum to 5.0%, vanadium to 10.%, cobalt to 8.0%, with remaining substantially iron, and all other elements totaling less than 1.0%.

(4) (Ferrous) powder metal steels with nominal chemistries falling within: 79 to 98% iron, 0-20% copper, 0.4 to 1.0 carbon, and 0.4.0% nickel.

(5) Age hardenable and martensitic stainless steels whose conpositions fall into the limits described in (3) above, except that they may have chromium up to 20%, aluminum up to 2.5%, titanium up to 1.5%, copper up to 4.0%, and columbium plus tantalum up to 0.5%.

In all cases, the core piece mechanical properties should exceed the following:

130 ksi ultimate tensile strength
80 ksi yield strength
5% tensile elongation
15% reduction in area
10 ft-lb. (izod) impact strength Wear resistant exterior skin 19, which may have a thickness within 0.01 to 0.20 inch range, need not be uniform in thickness. Materials suitable for the cone exterior include:

(1) A composite mixture of particles of refractory hard compounds in a binding metal or alloy where the refractory hard compounds have a microhardness of higher than 1,000 kg/mm$^2$ (50–100 g testing load), and a melting point of 1600° C. or higher in their commercially pure forms, and where the binding metal or alloy may be those based on iron, nickel, cobalt or copper. Examples of such refractory hard compounds include carbides oxides, nitrides and borides (or their soluble mixtures) of the Ti, W, Al, V, Zr, Cr, Mo, Ta, Nb and Hf.

(2) Specialty tool steels, readily available in powder having large amounts of strong carbide formers such as Ti, V, Nb, Mo, W and Cr, and a carbon content higher than 2.0% by weight.

(3) Hardfacing alloys based on transition elements Fe, Ni, or Co, with the following general chemistry ranges:

| | Cobalt Base | Nickel Base | Iron Base |
|---|---|---|---|
| Chromium | 25–30%* | 10–30% | 0–27% |
| Carbon | 0.1–3.5% | 0.4–3.0% | 0.1–4.0% |
| Tungsten | 4–13% | 0–5.0% | — |
| Molybdenum | 0–5% | 0–17.0% | 0–11% |
| Boron | 0–2.5% | 0–5.0% | — |
| Iron | 0–3.0% | 329% | Balance |
| Nickel | 0–3.0% | Balance | 0–1.75% |
| Cobalt | Balance | 0–12% | — |
| Manganese | 0–1.0% | 0–1.0% | 0–1.0% |

*percentage by weight (4) Wear-resistant intermetallic (Laves phase) materials based on cobalt or nickel as the primary contituent and having molybdenum (25–35%), chromium (8–18%), silicon (2–4%) and carbon 0.08% maximum.

Thrust-bearing 16 may be made of any metal or alloy having a hardness above 35 $R_c$. They may, in such cases, have a composite structure where part of the structure is a lubricating material such as molybdenum disulfide, tin, copper, silver, lead or their alloys, or graphite.

Cobalt-cemented tungsten carbide inserts 17*c* cutter teet 17 in FIG. 2, are to be readily available cobalt-tungsten carbide compositions whose cobalt content usually is within the 5–18% range.

Bearing alloy 15, if incorporated into the cone as a separately-manufactured insert, may either be a hardened or carburized or nitrided or borided steel or any one of a number of readily available commercial nonferrous bearing alloys, such as bronzes. If the bearing is weld deposited, the material may still be a bronze. If, however, the bearing is intergrally hot prssed in place from a previously applied powder, or if the insert is produced by any of the known powder metallurgy techniques, then it may also have a composite structure having dispersed within it a phase providing lubricating properties to the bearing.

EXAMPLES

An example for the processing of roller cutters includes the steps 1, 3,5, 6, 7, 10, 11, 12 and 14 provided in Table 1. A low alloy steel composition was blended to produce the final chemical analysis: 0.22% manganese, 0.23% molybdenum, 1.84% nickel, 0.27% carbon and remainder substantially iron. The powder was mixed with a very small amount of zinc stearate, for lubricity, and cold pressed to the shape of the core piece 11 (FIG. 2) under a 85 ksi pressure. The preform was then sintered for one hour at 2050° F. to increase its strength.

A slurry was prepared of Stellite No. 1 alloy powder and 3% by weight cellulose acetate and acetone in amounts adequate to provide the desired viscosity to the mixture. The Stellit No. 1 nominal chemistry is as follows: 30% chromium (be weight), 2.5% carbon, 1% silicon, 12.5% tungsten, 1% maximum each of iron and nickel with remainder being substantially cobalt. The slurry was applied over the exterior surfaces of the core piece using a painter's spatula, excepting those teeth surfaces where in service abrasive wear is desired in order to create self-sharpening effect. Only one side of the teeth was thereby covered with the slurry, and before the slurry could dry to harden, 0.08" thick cobalt cemented (6% cobalt) tungsten carbide inserts (FIG. 4,*a*) were pressed into the slurry. Excess slurry at the carbide insert edges was removed and interfaces smoothed out using the spatula.

A thin layer of an alloy steel powder was similarly applied, in a slurry state, on thrust bearing surfaces identified as 19 in FIG. 2. The thrust bearing alloy steel was identical in composition to the steel used to make the core piece, except the carbon content was 0.8% by weight. Thus, when given a hardening and tempering heat treatment the thrust bearing surfaces would harden more than the core piece and provide the needed wear resistance.

An AISI 1055 carbon steel tube having 0.1" wall thickness was fitted into the radial bearing portion of the core piece by placing it on a thin layer of slurry applied alloy steel powder used for the core piece.

The preform assembly, thus prepared, was dried in an oven at 100° F. for overnight, driving away all volatile constituents of the slurries used. It was then induction heated to about 2250° F. within four minutes and immersed in hot ceramic grain, which as also at 2250° F., within a cylindrical die. A pressure of 40 tons per square inch was applied to the grain by way of an hydraulic press. The pressurized grain transmitted the pressure to the preform in all directions. The peak pressure was reached within 4–5 seconds, and the peak pressure was maintained for less than two seconds and released. The die content was emptied, separating the grain from the now consolidated roller bit cutter. Before the part had a chance to cool below 1600° F., it was transferred to a furnace operating at 1565° F., kept there for one hour and oil quenched. To prevent oxidation the furnace atmosphere consisted of non-oxidizing cracked ammonia. The hardened part was then tempered for one hour at 1000° F. and air cooled to assure toughness in the core.

A similarly processed tensile test bar when tensile tested exhibited 152 ksi ultimate tensile strength, 141 ksi yield strength, 12% elongation and 39% reduction of area. Another test bar which was processed in the same manner as above, except tempered at 450° F., exhibited 215 ksi ultimate tensile strength, 185 ksi yield strength, 7% elongation and 21% reduction of area. Thus, it is apparent that one may easily develop a desired set of mechanical properties in the consolidated core piece by tempering at a selected temperature.

In another example, powder slurry for the wear resistant exterior skin and the thrust bearing surface was prepared using a 1.5% by weight mixture of cellulose acetate with Stellite alloy No. 1 powder. This preform was dried at 100° F. for overnight instead of 250° F. for two hours, and the remaining processing steps were identical to the above example. No visible differences were detected between the two parts produced by the two experiments.

In yet another example, radial bearing alloy was affixed on the interior wall of the core through the use of a nickel powder slurry similarly prepared as above. Once again the bond between the radial bearing alloy and the core piece was extremely strong as determined by separately conducted bonding experiments.

OTHER PERTINENT INFORMATION

The term "composite" is used both in the microstructural sense or from an engineering sense, whichever is more appropriate. Thus, a material made up of discrete fine phase(s) dispersed within another phase is considered a composite of phases, while a structure made up of discrete, relatively large regions joined or assembled by some means, together is also considered a "composite." An alloy composed of a mixture of carbide particles in cobalt, would microstructurally be a composite layer, while a cone cutter composed of various distinct layers, carbide or other inserts, would be a composite part.

The term "green" in Table 1, line 2, refers to a state where the powder metal part is not yet fully densified but has sufficient strength to be handled without chipping or breakage. Sintering (the same table, line 3) is a process by which powdered (or otherwise) material is put in intimate contact and heated to cause a metallurgical bond between them.

This invention introduces, for the first time, the following novel features to a drill bit cone:

(1) A "high-temperature - short-heating cycle" means of consolidation of a composite cone into a nearly finished product, saving substantial labor time and allowing the use of multiple materials tailored to meet localized demands on their properties.

(2) Application of material layers at or near room temperature, which eliminates thermally-induced structual damage if a thermally-activated process were to be used.

(3) A "high-temperature - high-pressure - short-time" processing scheme, as outlined in FIG. 3, where time-temperature dependent diffusion reactions are substantially reduced.

(4) A rock bit conical cutter having a hard, wear-resistant exterior skin and an interior profile which may consist of a layer bearing alloy or two different alloys, one for each radial and thrust bearings; all of which substantially surround a high-strength, tough core piece having protruding teeth.

(5) A conical cutter same as in Item (4), but having teeth partially covered on one side with an insert, preferably a cobalt-cemented tungsten carbide insert, which is bonded onto the interior core piece 11 by a thin layer of a carbide-rich hard alloy similar to those used for the exterior skin 19. This is illustrated in FIGS. 4(*a*) and 4(*c*), and is intended to provide a uniform, hard-cutting edge to the cutting teeth as they wear in downhole service; i.e., self-sharpening of teeth (see FIG. 4(*c*). This is to be contracted with problems of degradation of the cutting edge encountered in hardfaced teeth (see FIGS. 4(*b*) and 4(*d*).

(6) A conical cutter, as in Item (5), but having interior bearing surfaces provided by pre-formed and shaped inserts prior to hot consolidation of the composite cone. These inserts may be one or more pieces, at least one of which is the radial-bearing piece. Thrust bearing may be provided in the form of a single insert, or two or more inserts, depending on the cone interior design. These variations are illustrated in FIGS. 5(*a*)–5(*d*). FIG. 5(*a*) shows one insert 30; FIG. 5(*b*) shows a second insert 31 covering all interior surfaces, except for insert 30; FIG. 5(*c*) shows a third insert 32 combined with insert 30 and and a modified second insert 31'; and FIG. 5(*d*) shows modified second and third inserts 31'' and 32''.

(7) A conical cutter, as in Item (6), but having interior bearing inserts 33 and 34 bonded onto the interior core piece 11 by a thin layer or layers 33*a* and 34*a* of a ductile alloy, as illustrated in FIG. 6.

(8) A conical cutter same as in (5), but interior bearings surface is provided by a powder metallurgically appled layer of a bearing alloy.

FIG. 1 shows a bit body 40, threaded at 40*a*, with conical cutters 41 mounted to journal pins 42, with ball bearings 43 and thrust bearings 44.

Step 3 of the process as listed in Table 1 is for example shown in FIG. 7, the arrows 100 and 101 indicating isostatic pressurization of both interior and exterior surfaces of the core piece 11. Note that the teeth 17 are intergral with the core-piece and are also pressurized. Pressure application is effected for example by the use of rubber molds or ceramic granules packed about the core and teeth, and pressurized. Step 12 of the process as listed in Table 1 is for example shown in FIG. 8. The part as shown in FIG. 2 is embedded in hot ceramic grain or particulate 102, contained within a die 103 having bottom and side walls 104 and 105. A plunger 106 fits within the cylindrical bore 105*a* and presses downwardly on the hot grain 102 in which consolidating force is transmitted to the part, generally indicated at 106. Accordingly, the core 11 all components and layers attached thereto as referred to above are simultaneously consolidated and bonded together.

Referring now to FIG. 9, drill bit body 200 (typically of hardened steel) includes an upper thread 201 threadably attachable to drill pipe 202. The lower extent of the body is enlarged and fluted, as at 204, the flutes having outer surfaces 204*a* on which cladding layers 205 are formed, in accordance with the invention. The consolidated cladding layer 205 may for example consist of tungsten carbide formed from metallic powder, the method of application including the steps:

(a) applying to the body means a mixture of:
  (i) metallic powder
  (ii) fugitive organic binder
  (iii) volatile solvent
(b) drying the mixture, and
(c) burning out the binder and solvent at elevated temperature,
(d) and applying pressure to the powdered metal to consolidate same on the body means.

In this regard, the binder may consist of cellulose acetate, and the solvent may consist of acetone. Representative formulations are set forth below:

EXAMPLE 1

| Ingredient of fluid mixture | Weight percent range |
|---|---|
| tungsten carbide powder (0.001 mm to 0.100 mm) | 30 to 60 |
| cellulose acetate | 1.0 to 5.0 |
| acetone | As needed |
| Steel Powder (as binding metal) | 20 to 70 |

Other usable powdered metals include Co-Cr-W-C alloys, Ni-Cr-B alloys; other usable binders include waxes, polyvinylbutral (PVB); and other usable solvents include dibutyl phthalate (DPB).

Typically formulations are as follows:

EXAMPLE 2

| | |
|---|---|
| Stellite Alloy No. 1 powder (0.001 to 0.050 mm) | 97 to 98 wt. % |
| Parafin wax | 2 to 3 wt. % |

(Stellite is a trademark of Cabot Corporation, KoKomo, Ind., and Stellite No. 1 Alloy has a nominal composition by weight of 30% Cr, 12.5% W, 2.5% C and remaining substantially Cobalt).

EXAMPLE 3

| | |
|---|---|
| Deloro Alloy No. 60 | 90 to 95 wt. % |
| Polyvinyl-butral (PVB) | 3 to 6 wt. % |
| Dibytyl Phthalate (DPB) | 2 to 4 wt. % |

FIG. 9 also shows annularly spaced cutters 207, and a nozzle 208 (other bodies) bonded to the main body of the bit 200, by the processs referred to above. The cutters are spaced to cut into the well bottom formation in response to rotation of the bit about axis 209; and the nozzle 208 is angled to jet cutting fluid (drilling mud) angularly outwardly toward the cutting zones. Such fluid is supplied downwardly as via the drill pipe 202 and the axial through opening 200*a* in the bit. Accordingly, this invention can be used to attach various wear resistant or cutting members to a rock drill bit or it may be used to consolidate a rock bit in its totality integral with cutters, grooves, wear pads and nozzles. Other types of rock bits, such as roller bits, and shear bits, may also be manufactured using this invention.

FIGS. 10–12 show application of the invention to fabrication of drill string stabilizers 220 and including a sleeve 221 comprising a steel core 222, and an outer cylindrical member 223 attached to the core, i.e. at interface 224. Powdered metal cladding 225 (consolidated as per the above described method) is formed on the sleeve member 223, i.e. at the sleeve exterior, to define wear resistant local outer surfaces, which are spaced apart at 227 and spiral about central axis 228 and along the sleeve length, thereby to define well fluid circulation passages in spaces 227. Also, other bodies in the form of wear resistant pads 229 are joined (as by process to the sleeve member 223, and specifically to the spiraling lands 223*a*). FIG. 12*a*, for example, shows how the consolidated metal interface 230 forms between a pad 229 (or other metal body) and land 223*a* (or one metal body). See for example ceramic grain 231 via which pressure is exerted on the mixture (powdered metal and dried binder) to consolidate the powdered metal at elevated pressure (45,000 to 80,000 psi) and temperature (1950° F. to 2250° F.). The powdered metal may comprise hear, wear resistant metal such as tungsten carbide, and steel.

FIG. 13 shows application of the method of the invention to the joining of two (or more) separate steel bodies 240 and 241, at least one of which is less than 100% dense. Part 241 is placed in a die 242 and supported therein. A layer of a mixture (powdered steel, binder and solvent, as described) is then applied at the interface 243 between parts 240 and 241, and the parts may be glued together, for handling ease. The assembly is then heated, (1000° F. to 1200° F.) to burn out the binder (cellulose acetate). Ceramic grain 244 is then introduced around and within the exposed part of body 240, and pressure is exerted as via a plunger 245 in an outer container on cylinder 246. The pressure is sufficient to consolidate the powdered metal layer between parts (240 and 241) which was or were not 100% dense. The parts 240 and 241 may be heated to temperatures between 1900° F. to 2100° F. to facilitate the consolidation.

The invention makes possible the ready interconnection and/or cladding of bodies which are complexly shaped, and otherwise difficult to machine as one piece, or clad.

To demonstrate that separately manufactured metal shapes can be joined without canning and without special joint preparation, slugs measuring ¾ inches in height were prepared and joined. The commmon approach in these experiments involved the use of a powder metal-cement mixture as disclosed which when applied around the joint allowed the two slugs to be joined to be easily handled during processing.

The first experiment involved the use of two slugs of cold pressed and partially sintered (to 20% porosity) 4650 powder. The dry cut surfaces of the slugs were put together after partial application of 416 stainless steel powder-cementing mixture on the interface. The powder-cement mixture acted as a bonding agent as well as a marker to located the interface after consolidation.

The cementing mixture at and around the joint was allowed to dry in an oven at 350° F. The assembly of two 4650 slugs were then heated in a reducing atmosphere (dissociated ammonia) to 2050° F. for abut 10 minutes and pressed in hot ceramic grain using 25 tons/sq. in. load at 2000° F. Visual examination of the joined slugs indicated complete welding had taken place. Microstructural examination showed no evidence of an interface where no 416 powder markers were present, indicating an excellent weld.

A similar experiment without the use of 416 powder as marker at the interface, showed complete bonding of the two 4650 slugs.

In another experiment two wrought slugs of the A1S1 1018 carbon steel were joined by using a layer fo 4650 alloy steel powder in between the two pieces. The heating and hot pressing procedure was the same as above. The joint obtained indicated 100% bonding and could easily be located in the microstructure due to the difference in response to etching solution by th two steels.

A Rockwell-C hardness indentation, made under 150 kg load, right on the interface between 1018 and 4650 alloys dramatically demonstrated the strength of the bond between these two materials. No separation occured after the indentation. In fact, a tensile bar fabricated from a bar (formed by joining pressed and partially sintered 4650 and 416 stainless steel slugs) when pulled in tension, broke within the weaker member, 416 stainless, and the joint interface remained undisturbed. The break occured at 73,400 psi near the annealed tensile strength of wrought 416 stainless steel.

Experiments to date have shown that metal parts having 100% dense structures with wrought metal mechanical properties can be manufactured without canning, by utilizing heating-pressing cycles that last only few minutes. The process is also capable of producing comples shaped parts that cannot be produced by closed die pressing. This can be accomplished through joining of separately produced shapes having the following processing histories:

1. Cold pressed powder preform
2. Cold pressed and lightly sintered powder preform
3. Wrought or cast preform
4. Powder metal coating applied with a cement Structures highly complex in shapes can be produced through joining of such preforms in any combination.

In addition, each piece being joined may consist of a different alloy. Experiments indicate that there should be no major problems in bonding alloys based on iron including stainless steels, tool steels, alloy and carbon steels. Alloys belonging to other alloy systems, i.e., those base on nickel, cobalt and copper, may also be joiuned in any combination, provided care is taken to prevent oxidation at the interface.

The joint bond strength appears to be at least equal to the strength of the weakest component of the structure. This is much superior to the joiunt strengths obtained in any of the conventional cladding/coating processes, i.e., plasma sprauing, chemical or physical vapor deposition, braxing, Conforma-Cald process (Trademark of Imperial Clevite), d-gun coating (Trademark of Union Carbide). As a cladding process, therefore, the present invention is superior in terms of interfacial bond strength.

As a joining process, the bond strength's obtainable are comparable to those typically obtained by fusion welding, except that there is practically no dilution expected at the interface due to short time processing cycle, and the low bonding temperatures used. Thus, joint properties obtainable by joining papear superior to even the best (low dilution) fusion welding processes such as laser or electron beam welding.

The drill bit 301 of FIG. 14 is shown to have two conically shaped roller bit cutters 302 mounted to journal pins 303. The rolling cutter 302 illustrated in FIG. 15 includes a core member 304 onto which an annular layer of wear resistant coating 305 has been applied. The core has a hollow interior 306 and defines a central axis 307 of rotation.

Protusions 308 are cutting members (or teeth) and are attached to the core in rows encircling the cutter around the axis 307. The teeth configurations are further shown in FIGS. 16–24.

The core member 304 may be formed from powder metal by cold compacting, usually under a pressure of 40–80,000 psi by directional application of pressure while confined in a die. The hard wear resistant inserts 309*a* of FIGS. 16 and 17, or 309*b* of FIG. 18, and the inserts 310*a* of FIGS. 19 and 20, or 310*b* of FIG. 21, are positioned within the die prior to filling the die cavity with powder metal. After cold pressing, the inserts become an integral part of the core piece; however, small portions of the inserts as at 312 in FIG. 16, are typically left projecting free of the teeth. Hard, wear resistant alloy powder 311*a*, 311*b*, 311*c* and 311*d* is then applied to build up the teeth to the desired preform shape as shown. These hard layers 311*a*–311*d* are normally applied as slurries or mixtures of the powders of the hard metal and an organic binder, wetted by a volatile organic liquid, as described above, which helps to form a binder cake with the organic binder powder, and together, when dried, develop a substantial green strength within the preform to resist chipping during handling on the shop floor.

The extents and distributions (relative to the inserts) of the hard wear resistant alloy vary as exemplified in FIGS. 16–24 cross-sectional views; similarly, the orientations, shapes and sizes and the number of inserts may vary as illustrated in FIGS. 16–24 as at 309*a*, 309*b*, 310*a* and 310*b*. The inserts provide a self-sharpening effect and keep a sharp cutting edge 313 as abrasive and erosive action of the earth being drilled wears away the sides of the teeth as illustrated at 314 in FIG. 24, in FIG. 4, where a tooth of the type illustrated in FIG. 16 is shown after drilling has caused some wear. Arrow 330 indicates the direction of tooth travel.

The cold-pressed preform of the cutter, after application of the inserts 309*a* or 309*b*, 310*a* or 310*b* and the hard-wear resistant layers 311*a*–311*d* and the bearing alloy layers in the core interior as described in my prior application, is dried usually at room temperature to volatilize the volatile binding mix. The preform is then heated to the consolidation temperature between 1900° F. and 2250° F., and immersed within a hot refractory granular bed, usually at the same temperature as the preform or slightly higher. The granular refractory bed is then pressurized at between 45,000 and 80,000 psi.

The hot consolidation step of the process is shown in FIG. 8, the preform as at 103 being embedded in hot, refractory granular particulate 102, contained within a die having bottom and side walls 104 and 105. A plunger 106 fits within the bore and presses downwardly on the hot grain 102 in which consolidating force is transmitted to the part. Accordingly, the core 304 and all components and layers attached thereto, as referred to above, are simultaneously consolidated and/or bonded together to form a substantially solid, composite rolling cutter.

The aforementioned inserts may be of any wear resistant composition; they may also be less thatn 100% dense prior to the consolidation step. However, cobalt cemented tungsten carbide inserts available commercially are of particular advantage. The bonds between such carbide inserts and the steel matrix were found to be formed near 40,000 psi, and in abrasive wear tests, where the abrasive particles were silicon carbide, tungsten carbide—11% by weight Co. the compsoition performed 41 times better than the common Co-Cr-W-C hardfacing alloy. On the other hand, synthetic diamong-tungsten carbid-steel composites were found to be superior to the Co cemented tungsten carbide inserts, in that a 50 vol. % diamond—25 vol. % tungsten carbide and 25 vol. % steel composite wore 73 times slower than the Co-cemented tungsten carbide and 3,000 times slower than the weld deposited Co-Cr-W-C hardfacing alloy.

Thus, the invention provides a significantly improved roller bit cutter 302, for earth formation drilling purposes (as in drilling of oil and gas wells) the performance being enhanced by the inclusion of hard-wear resistant inserts 309 and 310 in the cutting teeth 308 and further improved by the application of hard-wear-resistant layers 311 from powder metal and together the two wear resistant materials provide long lasting, self-sharpening teeth 308 for the rolling cutters 302. The cutters are characterized as economically and effectively consolidated into a substantially dense structure from granular (powder), insert and/or solid forms of materials used in the cutters, thereby eliminating much of the machining, and secondary processing that are conventionally necessarily performed. The consolidation process takes place within a short span of time (1–10 minutes) in a hot refractory grain bed, under high pressure supplied by a press, allowing retention of the useful engineering properties of the materials used, making it possible to quickly and inexpensively consolidate and produce cutters of composite structures having carbides and/or diamond as the wear resistant phase.

A rolling cutter, used on earth drilling bits, according to the invention, comprises:

(a) a core member having a powder metallic structure and a hollow interior, the core defining an axis around which rotatably protruding teeth are formed;

(b) hard-wear-resistant insert separately manufactured;

(c) a hard-wear resistant layer of powder material applied substantialy to selected sides of the teeth which are directly subjected to wear during drilling;

(d) the core, inserts and wear-resistant layer being consolidated hot under a directionally applied pressure and when consolidated are strongly bond together forming a structure of substantially near 100% its calculated density, the inserts and hard powder applied layers providing the drill bit cutter with superior ability to drill due to the self-sharpened teeth provided by the use of the same.

Typically, the hard-wear-resistant inserts are cobalt cemented tungsten carbide; and the hard-wear-resistant layer of powder material applied to the sides of the teeth is typically substantially 20–70% by volume diamond granules mixed with 15–70% tungsten carbide powder and 10–70% steel powder. Further, the hard-wear-resistant inserts are typically a composite of 20–70% by volume diamond granules, 15–70% tungsten carbide and 10–70% steel powder; and the hard-wear-resistant layer of powder material applied to the sides of the teeth is substantially an alloy based on iron, or nickle or copper having up to 2.5% by weight carbon and 10 to 80% by weight tungsten carbide.

REFERENCES

1. R. K. Sorensen and A. T. Rallis, "Journal and Pilot Bearings with Alternating Surface Areas of Wear-Resistant and Anti-Galling Materials," U.S. Pat. No. 3,984,158 (Oct. 5, 1976)
2. H. W. Murdoch, "Drill Bit," U.S. Pat. No. 4,074,922 (Feb. 21, 1978)
3. T. H. Mayo, "Drill Bit Bearings," U.S. Pat. No. 3,721,307 (Mar. 20, 1971)
4. J. R. Whanger, "Journal Bearing with Alternating Surface Areas of Wear-Resistant and Anti-Galling Materials," U.S. Pat, No. 3,235,316 (Feb. 15, 1966)
5. J. R. Quinlan, "Aluminum Bronze Bearing," U.S. Pat. No. 3,995,017 (Dec. 7, 1976)
6. Hans B. Van Nederveen, Bosch en Duin and Martin B. Verburgh, "Drill Bit," U.S. Pat. No. 4,365,679 (Dec. 28, 1982)
7. Eric F. Drake, "Metal Cutting Tools Utilizing Gradient Composites," U.S. Pat. No. 4,368,788 (Jan. 18, 1983)
8. Eric F. Drake, "Cutting Teeth for Rolling Cutter Drill Bit", U.S. Pat. No. 4,372,404 (Feb. 8, 1983)

I claim:

1. The method of forming a cutter, which includes a core and wear resistant insert defining a body means which includes:

(a) applying to the body means a mixture of:
  (i) wear resistant powder, and
  (ii) binder said mixture being in fluid state and applied to said body means by one of the following:
  (i) dipping of the body means into said mixture,
  (ii) painting said mixture on the body means,
  (iii) spraying the mixture onto the body means, (b) volatilizing the binder (c) and applying sufficient pressure via a grain bed to the body means and powder at elevated temperature, to consolidate same, (d) at least one of the core and insert being consolidated at the same time as step (c) is carried out.

2. The method of claim 1 wherein said binder consists essentially of cellulose acetate.

3. The method of claim 1 wherein said binder also includes a solvent which consists of acetone.

4. The method of claim 1 wherein said powder is selected from the group consisting of silicon carbide, tungsten carbide, diamond, steel, cobalt, and alloys thereof.

5. The method of claim 1 wherein said body means is formed by joining multiple inserts to said core to define exposed cutting edges, the inserts being wear resistant.

6. The method of claim 1 wherein said core prior to said step (c), consists of powdered metal which is not completely consolidated.

7. The method of claim 5 wherein said core has protrusions to which said inserts are joined by said consolidated powder metal.

8. The method of any of claims 1–4, 5, 6 and 7 wherein said grain bed is located adjacent said body means and mixture, and said pressure is exerted on the bed via a plunger.

9. The method of claim 1 wherein said grain bed consists essentially of ceramic or refractory particles.

10. The method of claim 5 wherein said core has multiple protrusions in which multiple of said inserts are initially embedded.

11. The method of claim 10 wherein said consolidation is carried out to leave edges of said inserts exposed for engagement with an earth formation.

12. The method of claim 1 including maintaining the consolidated body means and powder at elevated temperature for at least 30 minutes, after said consolidation.

13. The method of claim 12 wherein said last mentioned elevated temperature is in excess of 1,000° F.

14. The method of claim 1 wherein both said body means and bed are at temperatures in excess of 2,000° F. during said consolidation.

15. The method which includes drilling an earth formation using the cutter of claim 16, and in such manner that the consolidated powder wears away as the inserts wear during their earth formation cutting actions.

16. The consolidated cutter produced by the process of claim 1.

17. A drill bit incorporating the cutter as claimed in 16.

18. A drill bit incorporating the cutter as claimed in 16, wherein the powder consists essentially of 20 to 70% by volume of diamond granules mixed with 15–70% by volume of tungsten carbide powder and 10–70% by volume of steel powder, all consolidated as defined.

19. A drill bit incorporating the cutter as claimed in 16, wherein the powder is an alloy comprising a base selected from the group that consists essentially of iron, nickle and copper, and up to 2.5% by weight carbon and 10 to 80% by weight tungsten carbide.

20. The cutter of claim 16 wherein multiple inserts are imbedded in at least one tooth.

21. The cutter of claim 20 wherein the inserts have exposed cutting edges protruding from the consolidated metal.

22. The cutter of claim 20 wherein said powdered metal is applied to sides of the inserts.

* * * * *